United States Patent [19]

Ehlbeck et al.

[11] Patent Number: 4,864,780

[45] Date of Patent: Sep. 12, 1989

[54] ENERGY-DISSIPATING RECEPTACLE FOR HIGH VELOCITY FLUID JETS

[75] Inventors: Hans E. Ehlbeck, Darmstadt; Claes O. Corin, Seeheim-Jugenheim; Imad Kamareddine, Brandau, all of Fed. Rep. of Germany

[73] Assignee: Flow Systems, Inc., Kent, Wash.

[21] Appl. No.: 126,774

[22] Filed: Nov. 27, 1988

[51] Int. Cl.[4] ..... B24C 9/00; B24C 1/00

[52] U.S. Cl. ..... 51/410; 51/424; 51/321; 83/177

[58] Field of Search ..... 51/410, 424, 425, 321, 51/270; 83/53, 177

[56] References Cited

U.S. PATENT DOCUMENTS

| | | | |
|---|---|---|---|
| 3,730,040 | 5/1973 | Chadwick et al. | 83/177 |
| 4,501,182 | 2/1985 | Jardat et al. | 83/177 |
| 4,532,949 | 8/1985 | Frank | 83/177 |
| 4,651,476 | 3/1987 | Marx et al. | 51/270 |
| 4,669,229 | 6/1987 | Ehlbeck | 83/53 |
| 4,698,939 | 10/1987 | Hashish | 83/177 |

FOREIGN PATENT DOCUMENTS

| | | | |
|---|---|---|---|
| 2720547 | 11/1977 | Fed. Rep. of Germany | 83/177 |
| 3518166 | 11/1986 | Fed. Rep. of Germany | 83/177 |
| 2553330 | 4/1985 | France | 83/177 |

*Primary Examiner*—Frederick R. Schmidt
*Assistant Examiner*—Robert A. Rose
*Attorney, Agent, or Firm*—Ashen Golant Martin & Seldon

[57] ABSTRACT

A jet-dissipating container for use with a fluid jet cutting system is disclosed of the type which holds a plurality of jet-dissipating suspensoids. The container includes a suspensoid-enfolding mesh of material. At least most of the suspensoids have exterior dimensions greater than the dimension of the openings of the mesh. Collection means are positioned about said container to collect and evacuate substances exiting the container through the openings of the mesh.

35 Claims, 5 Drawing Sheets

ENERGY-DISSIPATING RECEPTACLE FOR HIGH VELOCITY FLUID JETS

BACKGROUND OF THE INVENTION

This invention relates to fluid jet cutting systems, and more specifically, the energy-dissipating receptacle associated with such systems.

Cutting by means of a high-velocity fluid jet is well known in the art. Typically, a fluid such as water, at a pressure of 55,000 pounds per square inch, is forced through a jewel nozzle having a diameter of 0.003 to 0.030 inches to generate a jet having a velocity of up to three times the speed of sound. The jet thus produced can be used to cut through a variety of metallic and non-metallic materials such as steel, aluminum, paper, rubber, plastics, Kevlar, gravite and food products.

To enhance the cutting power of the fluid jet, abrasive materials have been added to the jet stream to produce a so-called "abrasive-jet". The abrasive-jet is used to precisely and accurately cut a wide variety of exceptionally hard materials such as tool steel, armor plate, certain ceramics and bullet proof glass, as well as certain soft materials such as lead. Typical abrasive materials include garnet, silica and aluminum oxide having grit sizes of #36 through #120. As used herein, the term "fluid jet" is used generically to means fluid jets and abrasive jets.

Typically, a fluid jet cutting system includes a nozzle for producing an axially directed high velocity cutting jet formed from a liquid; and means for positioning a workpiece axially downstream from the nozzle to be cut by said jet.

The high energy of the fluid jet must some how be absorbed once it has passed through the workpiece. Not only is the jet a danger to persons or equipment which might accidentally be impinged, but the fluid forming the jet must also be collected for proper disposal. Fluid-jet cutting systems have accordingly included an energy-dissipating receptacle for receiving the high-velocity jet of fluid after it emerges from the workpiece. For example, U.S Pat. Nos. 2,985,050 and 3,212,378 disclose a catch tank containing water or other fluid above a resilient pad of rubber or neoprene or other elastomeric material. Spray rails are provided on each side of the tank with a water spray being directed downwardly over the liquid surface to blanket the vapors of the cutting fluid and prevent their disbursal in the area of the cutting machine.

U.S. Pat. No. 3,730,040 discloses an energy-absorbing receptacle containing a hardened steel impact block at the bottom of the receptacle, and a frusto-conical baffle arrangement immediately adjacent the workpiece at the top of the receptacle. The jet passes into the receptacle, and through a liquid in the receptacle which absorbs a portion of the jet's energy. The jet thereafter impacts the steel block at the bottom of the receptacle. The orientation of the baffle plates are described as preventing sound, spray and vapor from passing back out of the entrance.

U.S. Pat. No. 4,669,229 discloses an energy-dissipating receptacle, whose interior cavity has side-walls which generally converge in the direction of jet flow. A plurality of circulating suspensoids within the cavity are impinged upon by the jet to dissipate the jet's kinetic energy. U.S. Pat. No. 4,669,229 is assigned to the assignee of this invention, and its contents are hereby incorporated by reference.

All of the foregoing receptacles have certain design criteria in common. First, means must be provided for the evacuation of spent fluid, kerf material and abrasive (in the case of abrasive jet cutting systems) from the receptical. Secondly, it has been found that the entrance of the receptacle preferably includes a wear-resistant lining, despite the considerable added cost. Third, the substantial noise generated by the fluid jet entering into air after cutting the workpiece, must be minimized by minimizing the open space between the cut material and the energy-dissipating interior of the receptacle. As those skilled in the art appreciate, noise is reduced to a minimum when there is direct contact between the energy-dissipating interior and the workpiece.

SUMMARY OF THE INVENTION

A fluid jet cutting system is described herein which includes a highly perforated structure positioned axially downstream from the workpiece and having a jet-accommodating inlet positioned closely adjacent the workpiece. A plurality of expendable suspensoids, at least most of which having exterior dimensions greater than the dimension of the perforations, are contained within the highly perforated structure. Collection means, positioned about the perforated structure, collect and evacuate substances exiting the structure through the perforations.

The aforedescribed invention, together with its many advantages, are described in the Description of the Preferred Embodiment, below, of which the following drawing is a part.

DETAIL DESCRIPTION OF THE PREFERRED EMBODIMENT

Figure 1:
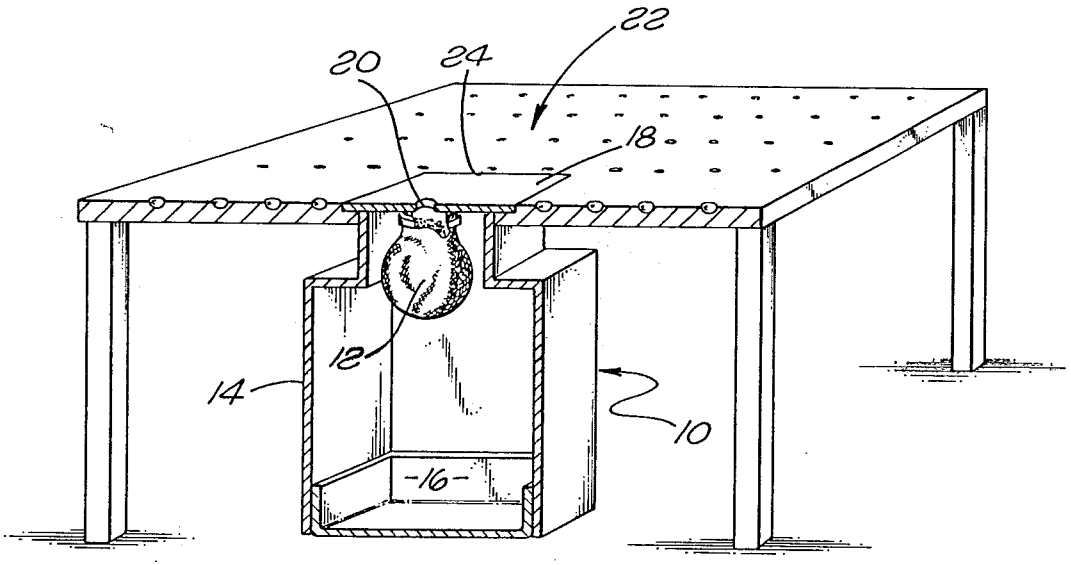
FIG. 1 is a front isometric sectional view, in schematic, of an energy-dissipating receptacle and workpiece-supporting table constructed in accordance with the invention.

Turning initially to FIG. 1, a sectional isometric view, in schematic, is presented showing an energy-dissipating receptacle 10 comprising a highly perforated structure 12, a supporting structure 14, and a basin 16. The top of the supporting structure 14 is closed by a generally planar cover plate 18. A jet-accommodating through-hole 20 is formed in the cover plate 18 to permit entry of the fluid jet into the perforated structure 12 after the jet emerges from the workpiece.

The energy-dissipating receptacle 10 is illustrated adjacent a workpiece-supporting table 22. The workpiece-supporting surface of the table 22 conveniently includes a notch 24 sized to surround the cover plate 18. The cover plate 10 is preferably at the same level as the workpiece-supporting surface of the table, but may be slightly lower or slightly higher depending on the characteristics of the workpiece being cut. The level of the cover plate 18 may easily be adjusted by shims positioned between the cover plate 18 and supporting member 14. Those skilled in the art will recognized that the table 22 may also be provided with integrated rollers 23 or other means for accommodating the sliding of the workpiece across the table's surface with minimal friction.

The basin 16 is positioned within the support structure 14 to collect water, kerf material, and any abrasive material which emerges from the perforated structure 12 as the workpiece is cut. The collected matter may be conveniently pumped from the basin into settling tanks, and the water recirculated to the jet-forming nozzle or, as described below, back into the perforated structure 12 as a cooling fluid.

Figure 2:
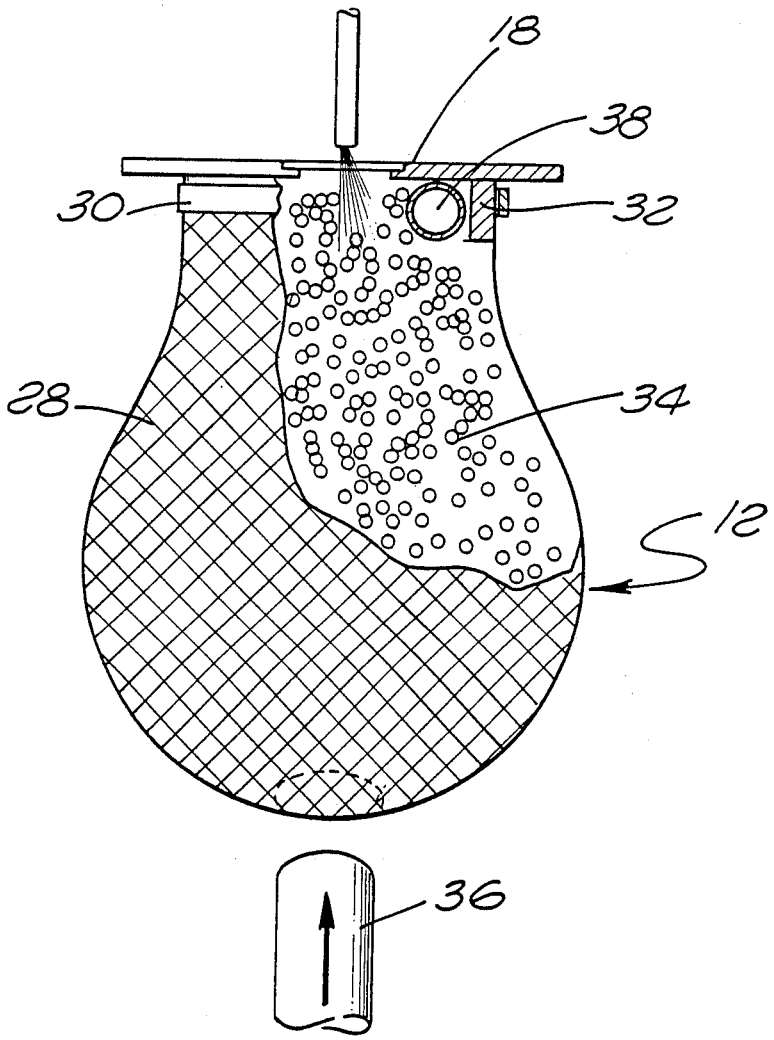
FIG. 2 is a front, partially sectioned, elevation view, in schematic, of an energy-dissipating receptacle constructed in accordance with the invention.

FIG. 2, is a front, partially sectioned, elevation view in schematic, showing the perforated structure 12. As shown in FIG. 2, the cover plate 18 includes a generally annular neck 32 extending downward from its underside.

The perforated structure 12 is preferably formed from a limp or extremely flexible Kevlar mesh 28, but may alternatively be formed from a similar mesh of any suitable textile or metal. The mesh material 28 is suspended from the cover plate 18 by a fastening belt 30 which secures the upper edge of the mesh material to the downwardly extending, annular neck 32 formed on the underside of the cover plate 18.

The mesh material is preferably one which is very flexible in all directions. By way of analogy, the mesh can be thought of as similar to the chain-link garments worn by medieval knights. When made from Kevlar or other suitable fabric, the mesh has an appearance more like a window curtain. In either case, the structure is highly flexible in all directions.

The interior of the mesh material 28 is substantially filled with a bed of suspensoids 34. As the jet enters the mesh structure 12, through the hole 20 in the cover plate 18, the jet encounters the bed of suspensoids therein. The majority of the jet's energy is expended as it strikes the bed of suspensoids, and the spent fluid escapes through the perforations of the mesh material to be collected in the basin 16 below.

As the suspensoids are worn by the impacting jet, they eventually become small enough to escape through the mesh material, making room for a supply of fresh suspensoids. In practice, it has been found that spherical suspensoids having an initial diameter of approximately 8 mm perform satisfactorily. It is also been found that the use of a mesh material with openings approximately ½ the diameter of the suspensoids prevents suspensoids from escaping through the mesh material until they are sufficiently worn by the impact of the fluid jet. As the suspensoids wear to approximately half their original dimension, and pass through the mesh material to the basin, refreshing of the suspensoid supply may conveniently be accomplished through an opening in the cover plate.

The jet tends to push the suspensoids out of the way as it enters and travels through the bed. Accordingly, the path cleared through the bed must be closed. The mesh structure negates the tendency of the impinging jet to push the suspensoids out of the way, by pushing inwardly against the suspensoid bed. This inwardly directed force is produced by the weight of the bed pressing downwardly against the bottom of the suspended structure 12. The downward force causes the sides of the mesh structure to become taut, thereby exerting the inwardly directed force against the sides of the bed. Since the spent fluid and waste material can freely escape the mesh material, a flushing action results which substantially discourages the caking of abrasive or other material within the suspended bed or against the interior of the receptacle.

It may also be observed that the preferred embodiment includes mesh material which is not self-supporting, but which is shaped to assume a "tear drop" configuration when filled with suspensoids and suspended from the cover plate. The relatively broader bottom portion of the mesh structure 12 enhances jet dissipation, since the jet spreads as it penetrates the suspensoids bed.

In accordance with another feature of the preferred embodiment, the mesh material may be deformed to either increase the density of the suspensoid bed or to force the suspensoid bed upward to a position abutting the underside of the cover plate 18. Accordingly, means 36 for compressing the interior volume of the mesh structure is schematically illustrated in FIG. 2 as comprising a block of material which is moved upward against the bottom of the mesh structure 12. By consequently decreasing the internal volume of the mesh structure, the suspensoids therein become more closely packed. Accordingly, it is possible to maintain the density of the suspensoid bed if worn suspensoids have escaped through the mesh material, and the replacement of suspensoids is impractical or undesirable during the cutting operation.

As indicated above, the compression of the internal mesh volume can also be used as a noise-reduction measure. Because a substantial amount of noise is generated when the fluid jet enters into air after emerging from the workpiece, minimization of the open space between the workpiece and the suspensoids bed consequently minimizes the noise. Accordingly, the aforedescribed compression in the mesh's internal volume can be utilized to force the suspensoids bed upward so that its upper level abuts the underside of the cover plate 18, essentially eliminating the free air space between the workpiece and bed.

Because the suspensoids can become hot as they dissipate the fluid jet's energy, it is advisable to introduce cooling water into the suspensoid bed during the cutting operation. A perforated cooling tube 38 is accordingly disposed about the inside diameter of the annular neck 32 to circumvent the upper portion of the mesh container 12. The tube 38 is coupled to a source of cooling fluid, such as the settling tanks to which the spent jet fluid is directed, to distribute relatively cool water onto the suspensoid bed during the cutting operation.

In practice, a suitable mesh structure has been found to have a height of between 80 mm and 200 mm. The inner diameter of the neck 32 is preferably not smaller than 60 millimeters, in order to avoid damage to the mesh material and the cooling tube by the deflected jet.

Figure 3:
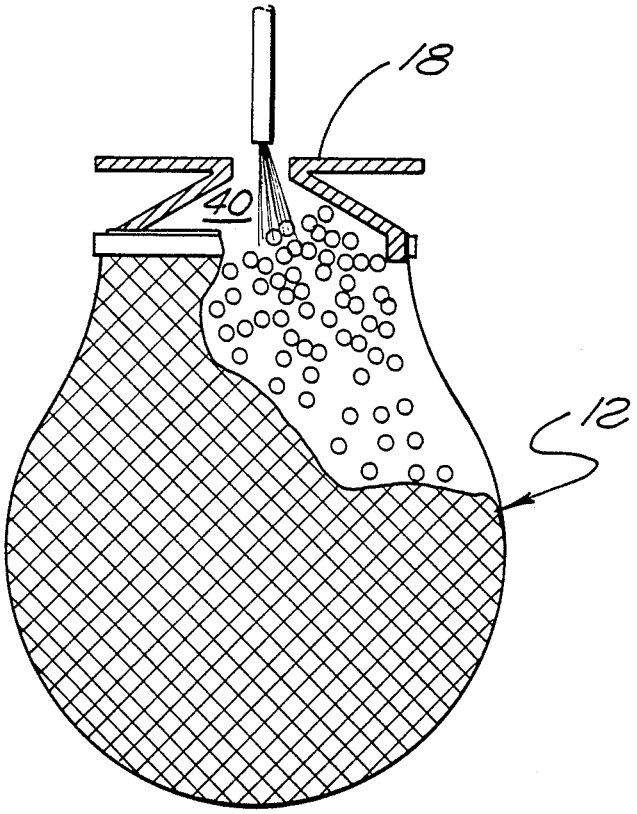
FIG. 3 is a front, partially sectioned, elevation view, in schematic, of a modified embodiment of the receptacle illustrated in FIG. 1.

As shown in FIG. 3, the cover plate 18 may be modified to prevent splash back of the jet by providing a downwardly diverging, generally conically shaped entrance 40 for the fluid jet as it enters the mesh structure 12.

Figure 4:
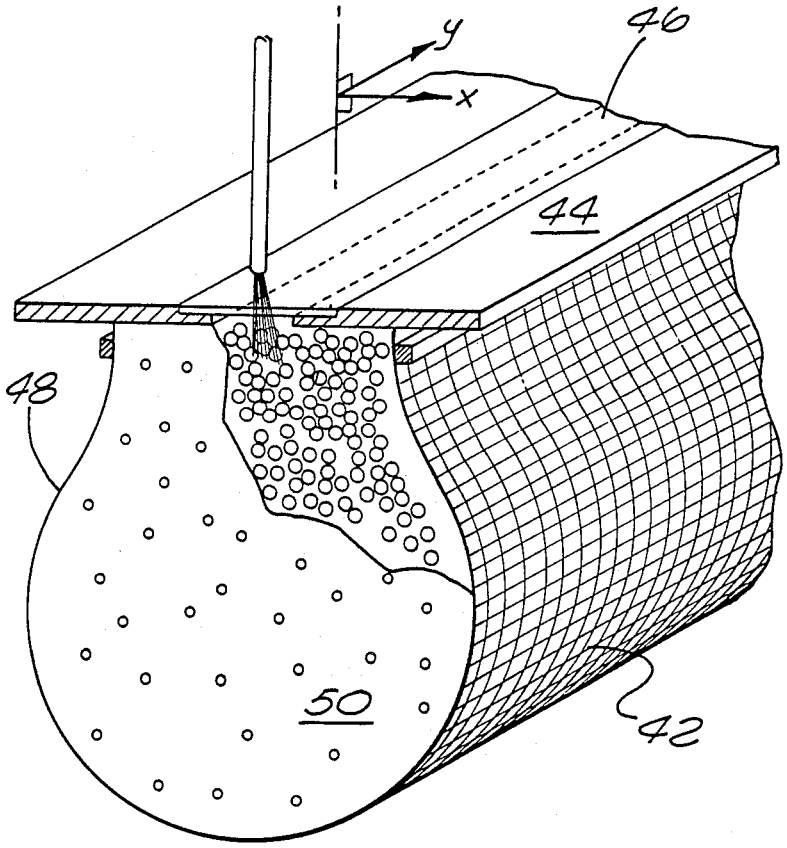
FIG. 4 is an isometric view, in schematic, of an alternative embodiment of an energy-disspating receptacle constructed to the accordance of the invention.

While foregoing embodiment is suitable for use with a jet that remains stationary with respect to the energy-dissipating receptacle, an alternative embodiment can be used with so called "X-Y" cutting systems, wherein the nozzle moves with respect to the receptacle. These cutting systems are capable of cutting a workpiece in two orthogonal directions which are both normal to the axis of jet travel. As shown in FIG. 4, the two cutting directions are conveniently referred to as the "X" direction and the "Y" direction.

It is well known in the art that energy-dissipating receptacles utilized in "x-y" cutting systems can move in one of the two directions with the nozzle, while being structured to capture the fluid jet as the nozzle moves with respect to the receptacle in the second of the two directions. The embodiment illustrated in FIG. 4 moves with the nozzle in the "X" direction, while accommodating the relative movement of the nozzle in the "Y" direction.

The mesh structure 42 is fastened to a cover plate 44 having a transverse jet-accommodating slot 46. The slot 46 permits the jet to enter the interior of the mesh structure as the nozzle moves in the "Y" direction.

As illustrated in FIG. 4, a generally rectangular length of mesh material may conveniently be fastened to the underside of a cover plate 44 of elongate shape in the "Y" direction. The resulting mesh structure has a generally "U" shaped cross section, but more preferably the same tear-drop shaped cross-section illustrated in the foregoing Figures.

Figure 5:
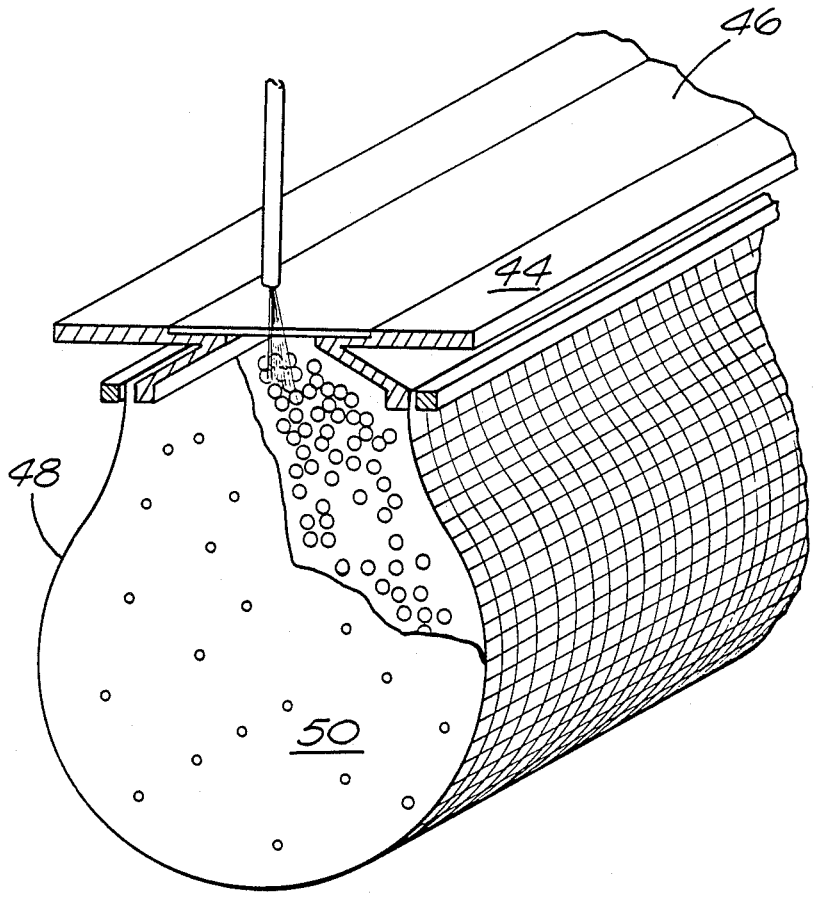
FIG. 5 is an isometric view, in schematic, showing a modification to the embodiment to FIG. 4.

The opposing ends 48 of the mesh structure are closed by perforated end plates 50 having the contour of the desired cross-section. Preferably, the end plates 50 should not be positioned closer than approximately 25 cm to the closest point at which a cut is to be made, because an end plate creates a rigidity in the structure which hampers the path-closing function of the mesh. The illustrated embodiment in FIG. 4 provides the same characteristics and advantages attributed to the embodiment illustrated in FIG. 2. Additionally, the embodiment illustrated in FIG. 4 may be modified as illustrated in FIG. 5 to provide a downwardly diverging entrance similar to entrance 40 in FIG. 3.

While the foregoing description includes detailed information which will enable those skilled in the art to practice the invention, it should be recognized that the description is illustrative and that many modifications and variations will be apparent to those skilled in the art having the benefit of these teachings. It is accordingly intended that the invention herein be defined solely by the claims appended hereto and that the claims be interpreted as broadly as permitted in light of the prior art.

We claim:

1. A fluid jet cutting system of the type including
- nozzle means for producing an axially directed, high velocity cutting jet formed from a liquid; and
- means for positioning a workpiece to be cut by said jet axially downstream from said nozzle means;

wherein the improvement comprises:
- a jet-dissipating container positioned axially downstream from said workpiece and having a jet-accommodating inlet positioned closely adjacent the workpiece, the container including a suspensoid enfolding mesh of material;
- a plurality of suspensoids within said container, at least most of the suspensoids having exterior dimensions greater than the dimension of the openings of the mesh; and
- collection means positioned about said container to collect and evacuate substances exiting the container through the openings of the mesh.

2. The fluid jet cutting system of claim 1 wherein the maximum dimension of each opening of the mesh is approximately half that of fresh suspensoids.

3. The fluid jet cutting system of claim 2 wherein the maximum dimension of substantially each opening of the mesh is approximately 4 mm.

4. The fluid jet cutting system of claim 1 wherein the mesh is formed from a non-self-supporting net of material so that the container thus formed is substantially shaped by the suspensoids contained therein.

5. The fluid jet cutting system of claim 1 or 4 wherein the material is Kevlar.

6. The fluid jet cutting system of claim 1 or 4 wherein the suspensoid-containing container has a generally bulb-shaped cross-section.

7. The fluid jet cutting system of claim 4 including means for compressing the volume of the container to maintain an effective suspensoid density within the container during the cutting operation.

8. The fluid jet cutting system of claim 4 including means for compressing the lower portion of the container to maintain the upper level of the suspensoids therein closely adjacent the jet-emerging side of the workpiece.

9. For use with a fluid jet cutting system, an energy dissipating receptacle comprising:
- a container having a jet-accommodating inlet positioned closely adjacent the workpiece;
- a plurality of suspensoids within said container,
- the container including a suspensoid enfolding mesh of material,
- at least most of the suspensoids having exterior dimensions greater than the dimension of the openings of the mesh; and
- collection means positioned about said container to collect and evacuate substances exiting the container through the openings of the mesh.

10. The receptacle of claim 9 wherein the maximum dimension of substantially each opening of the mesh is approximately half that of fresh suspensoids.

11. The receptacle of claim 10 wherein the maximum dimension of each opening of the mesh is approximately 4 mm.

12. The receptacle of claim 9 wherein the mesh is formed from a non-self-supporting net of material so that the container thus formed is substantially shaped by the suspensoids contained therein.

13. The receptacle of claim 9 or 12 wherein the material is Kevlar.

14. The receptacle of claim 9 or 12 wherein the suspensoid-containing container has a generally bulb-shaped cross section.

15. The cutting system of claim 1 wherein the receptacle includes
- a cover plate having a jet-receiving through-hole, an upper workpiece-facing surface and a bottom suspensoid-facing surface, and
- means for securing the suspensoid-enfolding mesh of material to the cover plate.

16. The cutting system of claim 15 wherein the cover plate includes a downwardly-extending, generally annular neck for securing the mesh to the cover plate.

17. The cutting system of claim 16 wherein the mesh is shaped to circumvent the outer surface of the annular neck, and the securing means includes fastening belt means for securing the upper edge of the mesh about the neck.

18. The cutting system of claim 17 including cooling tube means circumventing the annular neck of the cover plate for directing cooling fluid against the suspensoids.

19. The cutting system of claim 15 wherein the cover plate includes cooling tube means for directing cooling fluid against the suspensoids.

20. The cutting system of claim 19 including setting tank means communicating with the collection means for separating solids from liquids in the exiting substances, and means for coupling the settling tank means to the cooling tube means to utilize the separated liquid substances as the cooling fluid.

21. The system of claim 15 wherein the workpiece-positioning means includes a table having a workpiece supporting surface, the table having an opening in said surface which generally circumvents the jet and which is sized to accommodate the cover plate of the receptacle.

22. The system of claim 21 wherein the workpiece-facing surface of the cover plate is lower than the workpiece-supporting surface of the table.

23. The receptacle of claim 1 wherein the height of the meshed portion of the receptacle is in the range of 80 millimeters to 200 millimeters.

24. The receptacle of claim 1 wherein the jet-accommodating inlet is approximately 60 millimeters in diameter.

25. A fluid jet cutting system of the type including nozzle means for producing an axially directed, high velocity cutting jet formed from a liquid;

means for positioning a workpiece to be cut by said jet axially downstream from said nozzle means;

a highly perforated container positioned axially downstream from said workpiece and having a jet-accommodating inlet positioned closely adjacent the workpiece to capture the jet as it emerges from the workpiece, at least a portion of the container being in the form of a mesh of non-self-supporting, flexible material which defines at least some of the perforations;

a plurality of suspensoids within said container, at least most of the suspensoids having exterior dimensions greater than the dimension of the perforations, the container thus formed being substantially shaped by the suspensoids contained therein; and collection means positioned about said container to collect and evacuate substances exiting the container through the perforations.

26. The fluid jet cutting system of claim 25 wherein the mesh material is Kevlar.

27. The fluid jet cutting system of claim 25 wherein the suspensoid containing container is generally bulb-shaped.

28. The fluid jet cutting system of claim 25 including means for compressing the volume of the container to maintain an effective suspensoid density within the container during the cutting operation.

29. The fluid jet cutting system of claim 25 including means for compressing the lower portion of the container to maintain the upper level of the suspensoids therein closely adjacent the jet-emerging side of the workpiece.

30. For use with a fluid jet cutting system, an energy dissipating receptacle comprising:

a highly perforated container, at least a portion of which is in the form of a mesh of flexible, non-self-supporting material which defines at least some of the perforations, a plurality of suspensoids within said container, at least most of the suspensoids having exterior dimensions greater than the dimension of the perforations, the container thus formed being shaped by the suspensoids contained therein; and collection means positioned about said container to collect and evacuate substances exiting the container through the perforations.

31. For use with a fluid jet cutting system, an energy dissipating receptacle comprising:

a highly perforated container, at least a portion of which is in the form of a mesh of flexible, non-self-supporting material which defines at least some of the perforations, a plurality of suspensoids within said container, at least most of the suspensoids having exterior dimensions greater than the dimension of the perforations, and collection means positioned about said container to collect and evacuate substances exiting the container through the perforations.

32. In a waterjet cutting system of the type including nozzle means for producing an axially directed, high velocity cutting jet formed from a liquid, means for positioning a workpiece to be cut by said jet axially downstream from said nozzle means, and an energy-dissipating receptacle positioned downstream from the workpiece to capture the jet as it exists from workpiece and including a bed of suspensoids within the receptacle for dissipating the kinetic energy of the captured jet, a method for restraining the jet from displacing the suspensoids from its path as it enters the receptacle comprising the step of:

suspending a non-self-supporting mesh from a supporting member to form a suspensoid-supporting, energy-dissipating receptacle which translates the downward force of the suspensoids' weight into a horizontally inward force exerted by the mesh against the bed of contained suspensoids.

33. The method of claim 32 including the step of compressing the mesh during the cutting operation to reduce the internal volume of the receptacle as worn suspensoids escape through the mesh so that a desirable suspensoid density is maintained.

34. In a waterjet cutting system of the type including nozzle means for producing an axially directed, high velocity cutting jet formed from a liquid, means for positioning a workpiece to be cut by said jet axially downstream from said nozzle means, and an energy-dissipating receptacle positioned downstream from the workpiece to capture the jet as it exists from workpiece and including a bed of suspensoids within the receptacle for dissipating the kinetic energy of the captured jet, a method for minimizing the noise generated by the cutting jet comprising the steps of:

suspending a non-self-supporting mesh from a supporting member to form a suspensoid-retaining, energy-dissipating receptacle; and compressing the mesh to reduce the internal volume of the receptacle as worn suspensoids escape through the mesh during the cutting operation so that the upper surface of the suspensoid bed is maintained closely adjacent the workpiece.

35. In a waterjet cutting system of the type including nozzle means for producing an axially directed, high velocity cutting jet formed from a liquid, means for positioning a workpiece to be cut by said jet axially downstream from said nozzle means, and an energy-dissipating receptacle positioned downstream from the workpiece to capture the jet as it exists from workpiece and including a bed of suspensoids within the receptacle for dissipating the kinetic energy of the captured jet, a method for minimizing the accumulation of debris in the receptacle during the cutting process comprising the step of:

suspending a non-self-supporting mesh from a supporting member to form a suspensoid-retaining, energy-dissipating receptacle so that the freely escaping liquid from the spent jet effectively flushes the debris from the receptacle.

* * * * *